US007538492B2

(12) United States Patent
Park et al.

(10) Patent No.: US 7,538,492 B2
(45) Date of Patent: May 26, 2009

(54) PLASMA DISPLAY PANEL

(75) Inventors: Bong-Kyoung Park, Suwon-si (KR); Jae-Hyung Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/496,616

(22) Filed: Aug. 1, 2006

(65) Prior Publication Data

US 2007/0024196 A1 Feb. 1, 2007

(30) Foreign Application Priority Data

Aug. 1, 2005 (KR) ..... 10-2005-0070247

(51) Int. Cl.
*H01J 17/49* (2006.01)

(52) U.S. Cl. ..... 313/584; 313/582

(58) Field of Classification Search ..... 313/582–587; 315/169.4; 345/41–43, 60, 37
See application file for complete search history.

(56) References Cited

U.S. PATENT DOCUMENTS

| | | | |
|---|---|---|---|
| 5,541,618 | A | 7/1996 | Shinoda |
| 5,661,500 | A | 8/1997 | Shinoda et al. |
| 5,663,741 | A | 9/1997 | Kanazawa |
| 5,674,553 | A | 10/1997 | Sinoda et al. |
| 5,724,054 | A | 3/1998 | Shinoda |
| 5,786,794 | A | 7/1998 | Kishi et al. |
| 5,952,782 | A | 9/1999 | Nanto |
| RE37,444 | E | 11/2001 | Kanazawa |

(Continued)

FOREIGN PATENT DOCUMENTS

| | | |
|---|---|---|
| EP | 1 024 516 | 8/2000 |

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Nimeshkumar D Patel
*Assistant Examiner*—Christopher M Raabe
(74) *Attorney, Agent, or Firm*—Robert E. Bushnell, Esq.

(57) ABSTRACT

A plasma display panel (PDP) includes a front substrate and a rear substrate arranged opposite to each other, barrier ribs defining a plurality of discharge cells between the front substrate and the rear substrate, address electrodes extending in a first direction to correspond to the discharge cells, phosphor layers formed inside the discharge cells, and first electrodes and second electrodes extending in a second direction crossing the first direction and arranged opposite to each other to form a discharge gap therebetween. Each of the first electrodes and second electrodes may include line portions extending in the second direction and forming the discharge gap, and extensions protruding from the line portions, extending in a direction away from the discharge gap, and corresponding to a pair of adjacent discharge cells in the second direction.

19 Claims, 5 Drawing Sheets

U.S. PATENT DOCUMENTS

| | | | | |
|---|---|---|---|---|
| 6,522,072 | B1 * | 2/2003 | Yura et al. | 313/582 |
| 6,630,916 | B1 | 10/2003 | Shinoda | |
| 6,646,377 | B2 * | 11/2003 | Hashimoto | 313/582 |
| 6,707,436 | B2 | 3/2004 | Setoguchi et al. | |
| 6,747,409 | B1 * | 6/2004 | Han et al. | 313/582 |
| 6,960,880 | B2 * | 11/2005 | Chien et al. | 313/582 |
| 2003/0146713 | A1 | 8/2003 | Nagao et al. | |
| 2005/0029941 | A1 * | 2/2005 | Kwon et al. | 313/582 |
| 2005/0029945 | A1 * | 2/2005 | Hwang | 313/583 |
| 2005/0088094 | A1 * | 4/2005 | Kim et al. | 313/583 |
| 2005/0134176 | A1 | 6/2005 | Kwon et al. | |
| 2005/0179384 | A1 * | 8/2005 | Kwon et al. | 313/583 |
| 2005/0285527 | A1 * | 12/2005 | Kwon et al. | 313/583 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-160361 | 6/2001 |
| JP | 2001-307646 | 11/2001 |
| JP | 2001-325888 | 11/2001 |
| JP | 2002-150945 | 5/2002 |
| JP | 2005-056826 | 3/2005 |
| JP | 2006-004923 | 1/2006 |
| KR | 1998-043083 | 8/1998 |
| KR | 2005-0017689 | 2/2005 |
| WO | 0217345 | 2/2002 |
| WO | 2005043576 | 5/2005 |

OTHER PUBLICATIONS

European Search Report corresponding to European Patent Application No. 06118262.2, issued on Jan. 30, 2007.

* cited by examiner

PLASMA DISPLAY PANEL

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 1 Aug. 2005 and there duly assigned Serial No. 10-2005-0070247.

BACKGROUND OF THE INVENTION

1. Field of the Invention

The present invention relates to a Plasma Display Panel (PDP). More particularly, the present invention relates to a plasma display panel having an improved electrode structure to enhance luminous efficiency.

2. Description of the Related Art

Typically, a plasma display panel (hereinafter referred to as a "PDP") is a display device implementing an image with visible light generated by exciting phosphor with vacuum ultraviolet (VUV) rays radiated by plasma during gas discharge. The PDP can provide a super wide screen of greater than 60 inches with a thickness of less than 10 cm (centimeters). Additionally, the PDP has the characteristics of excellent color representation and no distortion phenomenon with regard to a viewing angle, since the PDP is a self-emissive display element like a cathode ray tube (CRT). Additionally, the PDP has advantages in productivity and production cost since its fabrication method is simple compared to that of a liquid crystal display (LCD). The PDP may be more suitable for a flat panel display for industrial use and a television display for home use in the next generation due to the above advantages.

A three-electrode surface-discharge type is one of the well-known structures of a PDP. The three-electrode surface-discharge type of structure includes a front substrate and a rear substrate maintaining a space therebetween, display electrodes on the front substrate, and address electrodes on the rear substrate crossing the display electrodes. Additionally, the front and rear substrates are combined and a discharge gas is filled into the space therebetween. In the PDP, an address discharge is generated by scan electrodes connected to each line and being individually controlled and address electrodes crossing the scan electrodes, and a sustain discharge is generated by the scan electrodes and the sustain electrodes facing each other and located on the same surface. Whether to discharge or not is determined by the address discharge, and brightness is expressed by the sustain discharge.

In this case, the scan and sustain electrodes in each of the discharge cells are formed of transparent electrodes so as not to block the visible light emitted from the discharge cells. However, since the transparent electrodes have very high resistance, metal electrodes are provided with the transparent electrodes to compensate for electrical conductivity thereof. Since the metal electrodes block visible light, the metal electrodes are formed on edge portions of the transparent electrodes in a widthwise direction of the transparent electrodes so as not to block the visible light emitted from the discharge cells.

Thus, the transparent electrodes are disposed around a discharge gap in which plasma discharge substantially occurs, thereby increasing discharge firing voltage. Additionally, since material of the transparent electrodes, e.g., ITO (Indium Tin Oxide), is very expensive, a unit price of production goes up and price competitiveness goes down. Additionally, since the sustain electrodes and the scan electrodes are formed having the transparent electrodes and the metal electrodes, work processes are very complicated and the unit price of production further increases.

The information disclosed above in this Background section is only provided to aid in understanding of the aspects of the present invention described in detail below.

SUMMARY OF THE INVENTION

The present invention is directed to a PDP which substantially overcomes one or more of the problems due to the limitations and disadvantages of the related art.

It is a feature of the present invention to provide a PDP in which luminous brightness is improved using metal electrodes and a stable discharge can be performed.

The above and other features and advantages of the present invention may be realized by providing a PDP including a front substrate and a rear substrate arranged opposite to each other, barrier ribs defining a plurality of discharge cells between the front substrate and the rear substrate, address electrodes extending in a first direction to correspond to the discharge cells, phosphor layers formed inside the discharge cells, and first electrodes and second electrodes extending in a second direction crossing the first direction and arranged opposite to each other to form a discharge gap therebetween.

In this case, each of the first electrodes and second electrodes may include line portions extending in the second direction and forming the discharge gap, and extensions protruding from the line portions, extending in a direction away from the discharge gap, and corresponding to a pair of adjacent discharge cells in the second direction.

The line portions may be arranged adjacent to centerlines passing along centers of the discharge cells in the second direction.

The extensions may include first electrode portions spaced apart from the line portions by a predetermined gap, and a pair of second electrode portions connecting the first electrode portions to the line portions.

The first electrode portions may be arranged to cover the pair of adjacent discharge cells in the second direction.

The second electrode portions may be arranged adjacent to centerlines passing along centers of the discharge cells in the first direction.

A plurality of the extensions may be formed along the second direction, and among a pair of adjacent extensions in the second direction, the second electrode portion of the one extension and the second electrode portion of the other extension may be arranged to correspond to the discharge cell.

Recesses concaved toward the centers of the discharge cells may be formed in the line portions, and a gap between the recesses formed in the line portions of the first electrodes and the recesses formed in the line portions of the second electrodes may be greater than a gap between the line portions of the first electrodes and the line portions of the second electrodes.

The second electrode portions may be connected to the recesses.

The recesses may be arranged on centerlines passing along centers of the discharge cells in the first direction.

The first electrodes and the second electrodes are made of a metal.

According to another exemplary embodiment, each one of the first electrodes and second electrodes may include line portions extending in the second direction, and extensions protruding toward centers of the discharge cells from the line portions, forming the discharge gap, and corresponding to a pair of adjacent discharge cells in the second direction.

In this case, the extensions may include first electrode portions spaced apart from the line portions by a predetermined gap, a pair of second electrode portions extending toward the first electrode portions from the line portions, and a pair of third electrode portions connecting the pair of second electrode portions to the first electrode portions in an oblique direction.

In addition, among a pair of adjacent extensions in the second direction, the second electrode portion of the one extension and the second electrode portion of the other extension are arranged to correspond to the discharge cell.

In addition, a gap between the third electrode portions of the first electrodes and the third electrode portions of the second electrodes may be greater than a gap between the first electrode portions of the first electrodes and the first electrode portions of the second electrodes.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
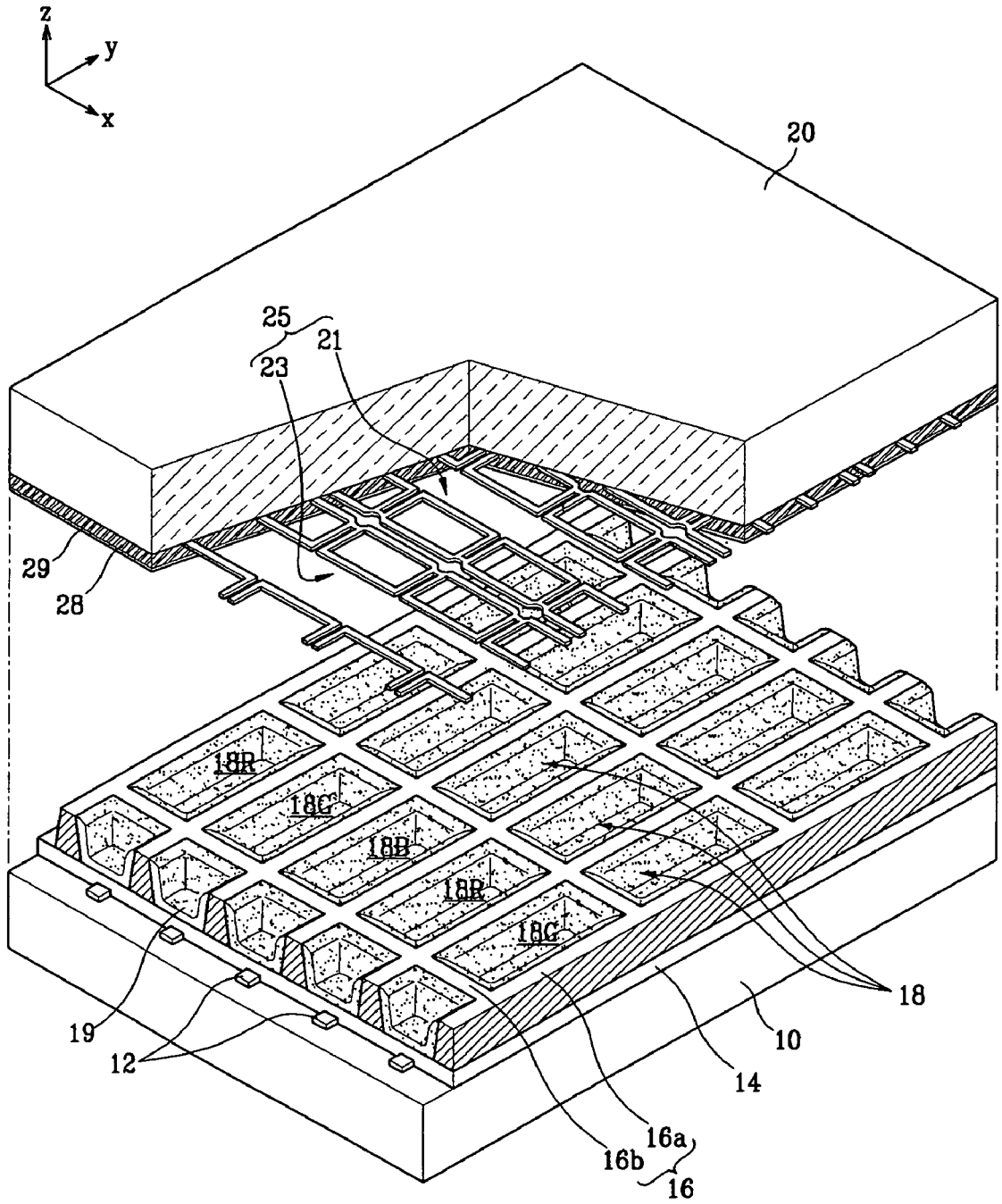
FIG. 1 is a partially exploded perspective view showing a plasma display panel (PDP) according to a first exemplary embodiment of the present invention.

The present invention will now be described more fully hereinafter with reference to the accompanying drawings, in which an exemplary embodiment of the present invention is shown. The present invention may, however, be embodied in different forms and should not be construed as limited to the embodiment set forth herein. Rather, this embodiment is provided so that this disclosure will be thorough and complete, and will fully convey the scope of the present invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, or one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 is a partially exploded perspective view showing a plasma display panel (PDP) according to a first exemplary embodiment of the present invention.

Referring to FIG. 1, a PDP according to an exemplary embodiment of the present invention may include a front substrate 20 and a rear substrate 10 disposed opposite to each other with a predetermined gap therebetween. Color-based discharge cells 18 (18R, 18G, and 18B) are partitioned using barrier ribs 16, at a space between the rear and front substrates 10 and 20. Further, phosphor layers 19, which are excited to emit visible light, are formed in each of the discharge cells 18. In more detail, the phosphor layers 19 are formed on side surfaces of the barrier ribs, and on bottom surfaces of the discharge cells 18. The discharge cells 18 are filled with a discharge gas to generate a plasma discharge, and the discharge gas includes a mixture of xenon (Xe) and neon (Ne).

Address electrodes 12 are formed to extend in a first direction (y axis direction in the drawing) on the inner surface of the rear substrate 10 opposite to the front substrate 20. The address electrodes 12 are spaced apart from each other while corresponding to each of the discharge cells 18. In addition, the address electrodes 12 are covered with dielectric layers 14. The barrier ribs 16 have a predetermined pattern and are formed on the dielectric layers 14.

The barrier ribs 16 partition the discharge cells 18, i.e., discharge spaces where the discharge is performed. This prevents cross-talk between adjacent discharge cells 18. The barrier ribs 16 include longitudinal barrier ribs 16*a* and transverse barrier ribs 16*b*. The longitudinal barrier ribs 16*a* extend in the first direction (y-axis direction in the drawing) and are spaced apart from each other with the address electrodes 12 therebetween, and the transverse barrier ribs 16*b* are formed to extend in a second direction (x axis direction in the drawing) crossing the first direction. The longitudinal barrier ribs 16*a* and the transverse barrier ribs 16*b* are in one plane. In this way, discharge cells 18 with a closed structure are formed.

The aforementioned structure of the barrier ribs is a preferable exemplary embodiment, and accordingly it is possible that variously shaped barrier ribs such as stripe-type barrier ribs can be arranged to be in parallel with the address electrodes 12, etc.

Ultraviolet light emitted by the plasma discharge excites the phosphor layers 19 that are formed inside the discharge cells 18, thereby causing visible light to be emitted. As shown in FIG. 1, the phosphor layers 19 are formed on side surfaces of the barrier ribs 16, and on bottom surfaces of the discharge cells 18 defined by the barrier ribs 16. The phosphor layers 19 can each be formed using any one of red (R), green (G), and blue (B) phosphors to represent color. Accordingly, the phosphor layers 19 may be classified into red, green, and blue discharge cells 18R, 18G, and 18B. As described above, the discharge gas, such as the mixture of neon (Ne) and xenon (Xe), is filled into the discharge cells 18 where the phosphor layers 19 are formed.

The front substrate 20 is made of a transparent material such as glass such that visible light can transmit the front substrate 20 to display image. Display electrodes 25 are formed to extend in the second direction (x axis direction in the drawing) crossing the first direction (y axis direction in the drawing) on an inner surface of the front substrate 20 opposite to the rear substrate 10, corresponding to each of the discharge cells 18. Each display electrode 25 is functionally comprised of a first electrode 21 (hereinafter referred to as a scan electrode) and a second electrode 23 (hereinafter referred to as a sustain electrode).

The scan electrode 21 interacts with an address electrode 12 to select a discharge cell 18 to be turned on, and the sustain electrode 23 interacts with the scan electrode 21 to generate a sustain discharge at the selected discharge cell 18. The scan electrodes 21 and the sustain electrodes 23 are arranged to face each other in the discharge cells 18 to form a discharge gap In an exemplary embodiment, the display electrodes 25 with the above-described structure may include line portions extending in the second direction (x-axis direction in the drawing) and extensions protruding from the line portions.

The line portions and extensions may be made of metal with good electrical conductivity, e.g., Cr or Ag. A detailed description of the display electrodes 25 will be given later with the description of the discharge cells 18.

The display electrodes 25 are covered with dielectric layers 28, which are formed of dielectric materials such as PbO, $B_2O_3$, or $SiO_2$. The dielectric layers 28 prevent charged particles from directly colliding with and damaging the display electrodes 25 in the discharge, and collect the charged particles.

Protective layers 29, which are formed of magnesium oxide (MgO), are formed on the dielectric layers 28. The protective layers 29 prevent charged particles from directly colliding with and damaging the dielectric layers 28 in the discharge. Further, when the charged particles collide with the protective layers 29, secondary electrons are emitted, thereby improving discharge efficiency.

Figure 2:
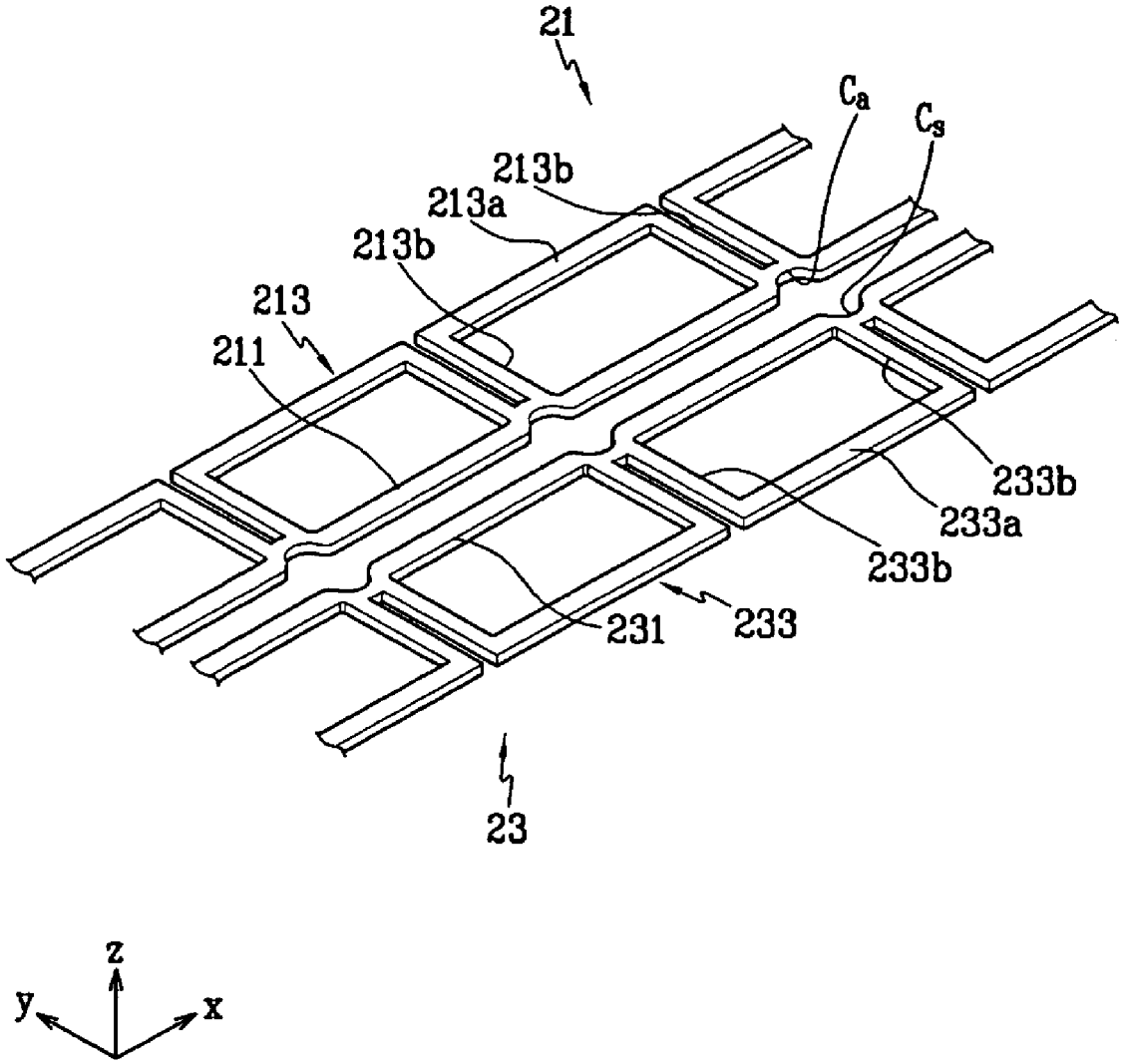
FIG. 2 is a partially perspective view showing display electrodes according to the first exemplary embodiment of the present invention.

FIG. 2 is a partially perspective view showing display electrodes according to the first exemplary embodiment of the present invention.

Referring to FIG. 2, each of the scan and sustain electrodes 21 and 23 includes line portions 211 and 231 extending in the second direction (x-axis direction in the drawing) and extensions 213 and 233 protruding in the first direction (y-axis direction in the drawing) from the line portions 211 and 231. Further, a discharge gap is formed between the line portions 211 of the scan electrodes 21 and the line portions 233 of the sustain electrodes 23, and the extensions 211 and 233 are formed to extend in a direction away from the discharge gap.

Specifically, the line portions 211 and 231 can be formed in a strip shape and extend in the second direction (x-axis direction in the drawing).

The extensions 213 and 233 may include first electrode portions 213*a* and 233*a* in a line shape and a pair of second electrode portions 213*b* and 233*b*.

The first electrode portions 213*a* and 233*a* are spaced apart from the line portions 211 and 231 with a predetermined gap therebetween. The pair of second electrode portions 213*b* and 233*b* connect the first electrode portions 213*a* and 233*a* to the line portions 211 and 231. The extensions 213 and 233 are formed substantially in a loop shape, since the extensions 213 and 233 include the first electrode portions 213*a* and 233*a* and the pair of second electrode portions 213*b* and 233*b*.

In the meantime, the second electrode portions 213*b* and 233*b* extend from the line portions 211 and 231 in a direction perpendicular thereto toward the first electrode portions 213*a* and 233*a* (y-axis direction in the drawing). Further, the second electrode portions 213*b*, 233*b* are connected to the first electrode portions 213*a* and 233*a* at a right angle. Accordingly, the extensions 213 and 233 and the line portions 211 and 231 can form a loop in a quadrilateral shape.

Recesses Ca and Cs may be formed in the line portions 211 and 231. That is, the recesses Ca and Cs are formed at locations where the line portions 211 and 231 and the second electrode portions 213*b* and 233*b* intersect each other. The recesses Ca and Cs are concaved toward a discharge gap between the line portions 211 of the scan electrodes 21 and the line portions 231 of the sustain electrodes 23. Since the recesses Ca and Cs are formed in the line portions 211 and 231, two discharge gaps with different size, i.e., long discharge gap and short discharge gap may be formed between the line portions 211 of the scan electrodes 21 and the line portions 231 of the sustain electrodes 23. Accordingly, a discharge may be initiated in the short discharge gap when low discharge firing voltage are applied at sustain discharge period, and the discharge may be diffused into the overall discharge cells via the long discharge gap.

Figure 3:
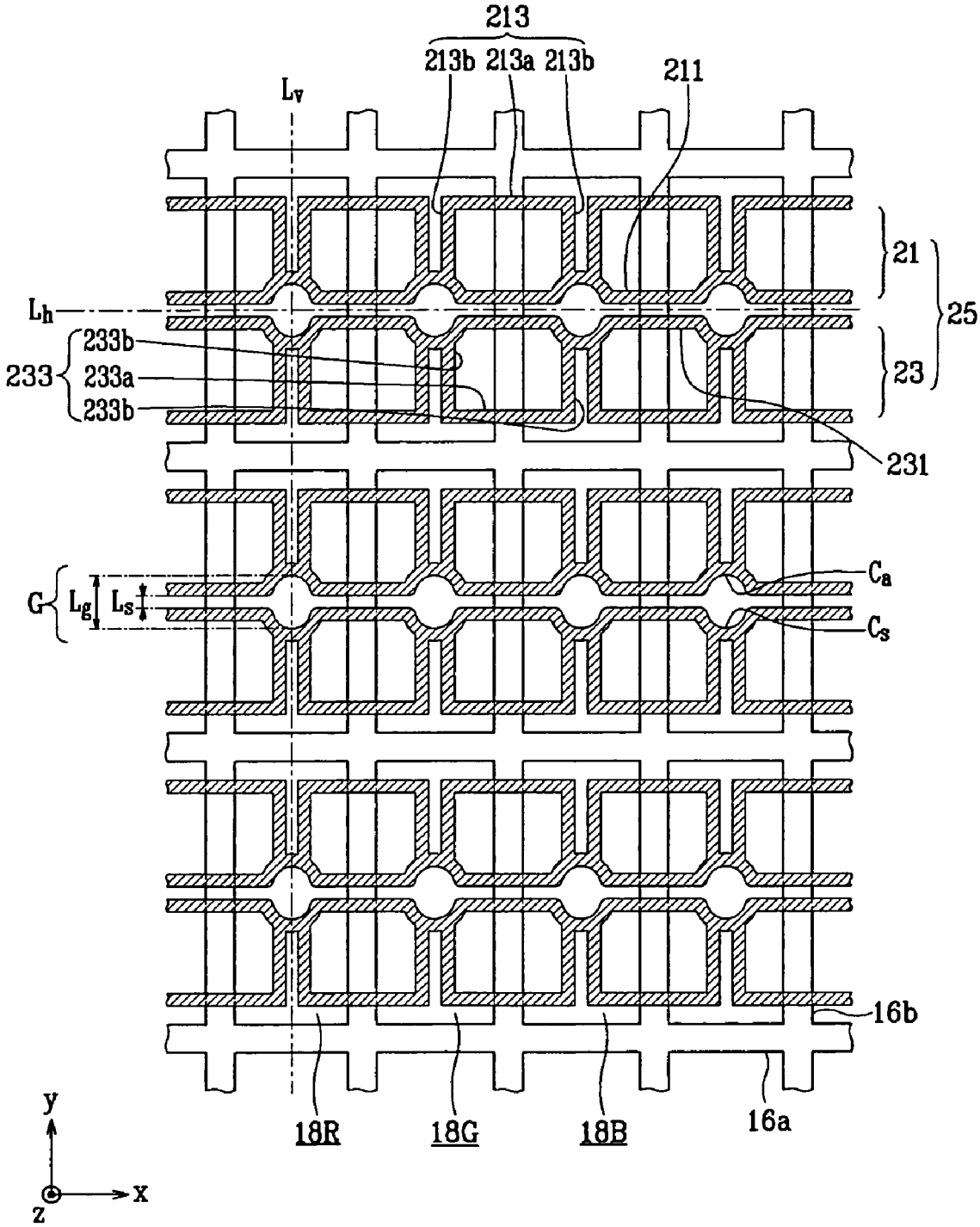
FIG. 3 is a schematic plan view showing an arrangement relationship between display electrodes and discharge cells of the PDP according to the first exemplary embodiment of the present invention.

FIG. 3 is a schematic plan view showing an arrangement relationship between display electrodes and discharge cells of the PDP according to the first exemplary embodiment of the present invention.

Referring to FIG. 3, the discharge cells 18 are classified into red, green, and blue discharge cells 18R, 18G, and 18B, respectively, according to colors of the phosphor layers. In FIG. 3, the discharge cells of the same colors are arranged along the first direction (y-axis direction in the drawing), and the red, green, and blue discharge cells 18R, 18G, and 18B are arranged along the second direction (x-axis direction in the drawing).

The display electrodes 25 including the scan electrodes 21 and the sustain electrodes 23 extend in the second direction (x-axis direction in the drawing) and correspond to each discharge cell 18.

Further, when Lv is a centerline passing along centers of the discharge cells 18 in the first direction (y-axis direction in the drawing) and Lh is a centerline passing along centers of the discharge cells 18 in the second direction (x-axis direction), the scan electrodes 21 are arranged upward with respect to the centerline Lh and the sustain electrodes 23 are arranged downward with respect to the centerline Lh. Specifically, the line portions 211 of the scan electrodes 21 and the line portions 231 of the sustain electrodes 23 are arranged adjacent to the centerline Lh. In addition, the scan electrodes 21 and the sustain electrodes 23 are symmetrically formed with the centerline Lh therebetween.

In the meantime, the extensions 213 of the scan electrodes 21 and the extensions 233 of the sustain electrodes 23 are formed to correspond to a pair of adjacent discharge cells in the second direction (x-axis direction in the drawing). That is, the first electrode portions 213*a* of the scan electrodes 21 and the first electrode portions 233*a* of the sustain electrodes 23 are arranged to cover the pair of adjacent discharge cells in the second direction.

In the present exemplary embodiment, a plurality of extensions 213 and 233 are arranged along the second direction (x-axis direction in the drawing). In addition, among a pair of adjacent extensions 213 and 233 in the second direction, the second electrode portion 213*b* and 233*b* of the one extension 213 and 233 and the second electrode portion 213*b* and 233*b* of the other extension 213 and 233 are arranged to correspond to one discharge cell 18. In this case, the second electrode portions 213*b* and 233*b* corresponding to the discharge cell 18 are arranged adjacent to the centerline Lv and are arranged opposite to each other with the centerline Lv therebetween.

The recesses Ca and Cs formed in the line portions 211 and 233 are arranged on the centerline Lv. That is, the recesses Ca of the scan electrodes 21 and the recesses Cs of the sustain electrodes 23 are arranged opposite to each other in the central region of the discharge cells 18. Accordingly, as shown in FIG. 3, a gap Lg between the recess Ca of the scan electrode 21 and the recess Cs of the sustain electrode 23 is greater than a gap Ls between the line portion 211 of the scan electrode 21 and the line portion 231 of the sustain electrode 23.

Since the display electrodes 25 having the above structure are arranged in the discharge cells 18, the aperture ratio and luminous efficiency may be increased compared to conventional PDP.

In addition, a discharge initiated in the short discharge gap is transferred to the long discharge gap, and the discharge is diffused from the long discharge gap into the overall discharge cells via the extensions, thereby enhancing discharge efficiency.

In addition, since a plurality of second electrode portions are arranged to correspond to one discharge cell 18, a discharge may be easily diffused into the overall discharge cell and discharge efficiency may be further enhanced.

In addition, since the first and second electrode portions are formed in a simple shape, the display electrodes may be easily manufactured using various methods such as a direct imaging method.

Figure 4:
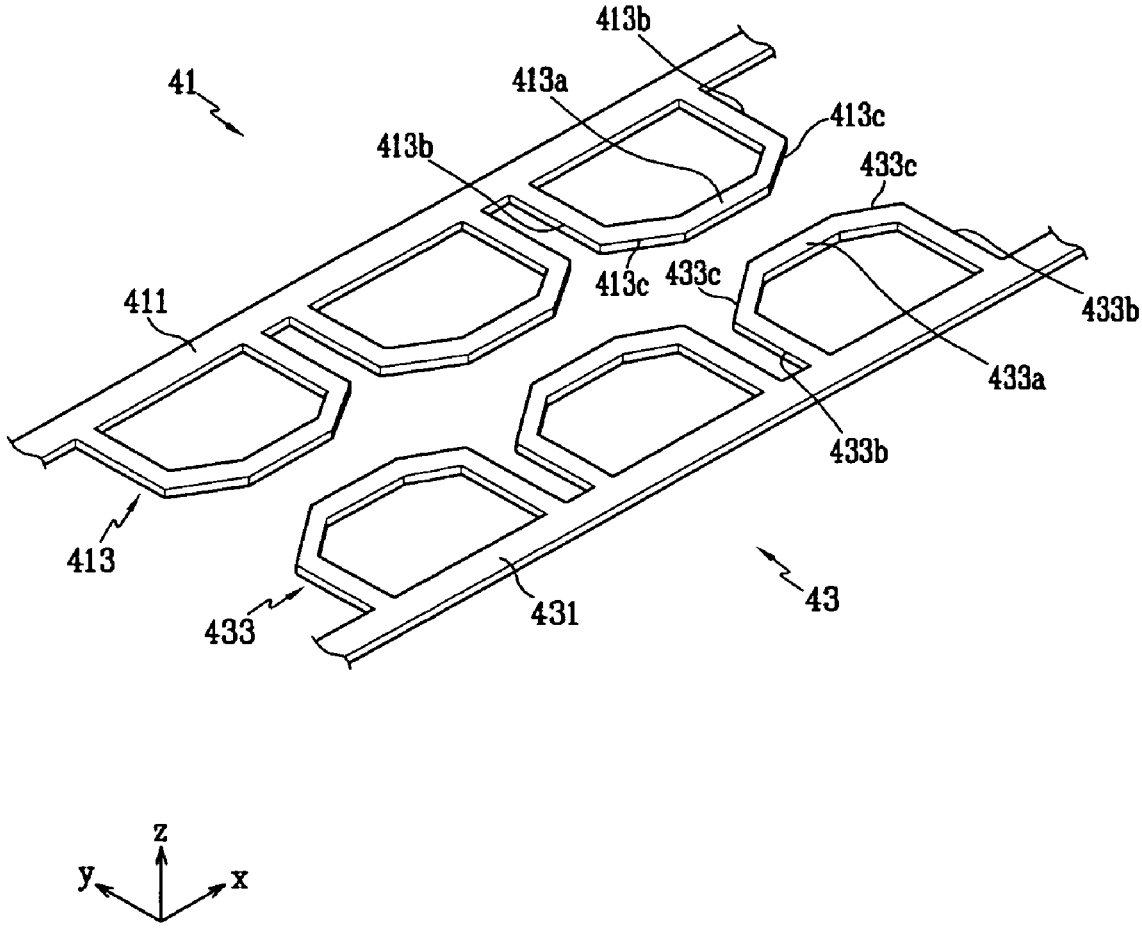
FIG. 4 is a partially perspective view showing display electrodes according to a second exemplary embodiment of the present invention.

FIG. 4 is a partially perspective view showing display electrodes according to a second exemplary embodiment of the present invention.

Referring to FIG. 4, each one of scan and sustain electrodes 41 and 43 includes line portions 411 and 431 extending in the second direction (x-axis direction in the drawing) and extensions 413 and 433 protruding in the first direction (y-axis direction in the drawing) from the line portions 411 and 431. In further detail, the extensions 413 of the scan electrode 41 are formed to protrude toward the sustain electrode 43 that is opposite to the scan electrode 41, and the extensions 433 of the sustain electrode 43 are formed to protrude toward the scan electrode 41 that is opposite to the sustain electrode 43.

Specifically, the line portions 411 and 431 are formed in a strip shape and extend in the second direction (x-axis direction in the drawing).

The extensions 413 and 433 may include first electrode portions 413*a* and 433*a* in a line shape, a pair of second electrode portions 413*b* and 433*b*, and a pair of third electrode portions 413*c* and 433*c*.

The first electrode portions 413*a* and 433*a* are spaced apart from the line portions 411 and 431 with a predetermined gap therebetween. The pair of second electrode portions 413*b* and 433*b* extend toward the first electrode portions 413*a* and 433*a* from the line portions 411 and 431. The pair of third electrode portions 413*c* and 433*c* connect the second electrode portions 413*b* and 433*b* to the first electrode portions 413*a* and 433*a* in an oblique direction. That is, an end of the second electrode portions 413*b* and 433*b* is connected to an end of the first electrode portions 413*a* and 433*a* in an oblique direction. The extensions 413 and 433 are substantially formed in a loop shape, since the extensions 413 and 433 include the first electrode portions 413*a* and 433*a*, the pair of second electrode portions 413*b* and 433*b*, and the pair of third electrode portions 413*c* and 433*c*.

Figure 5:
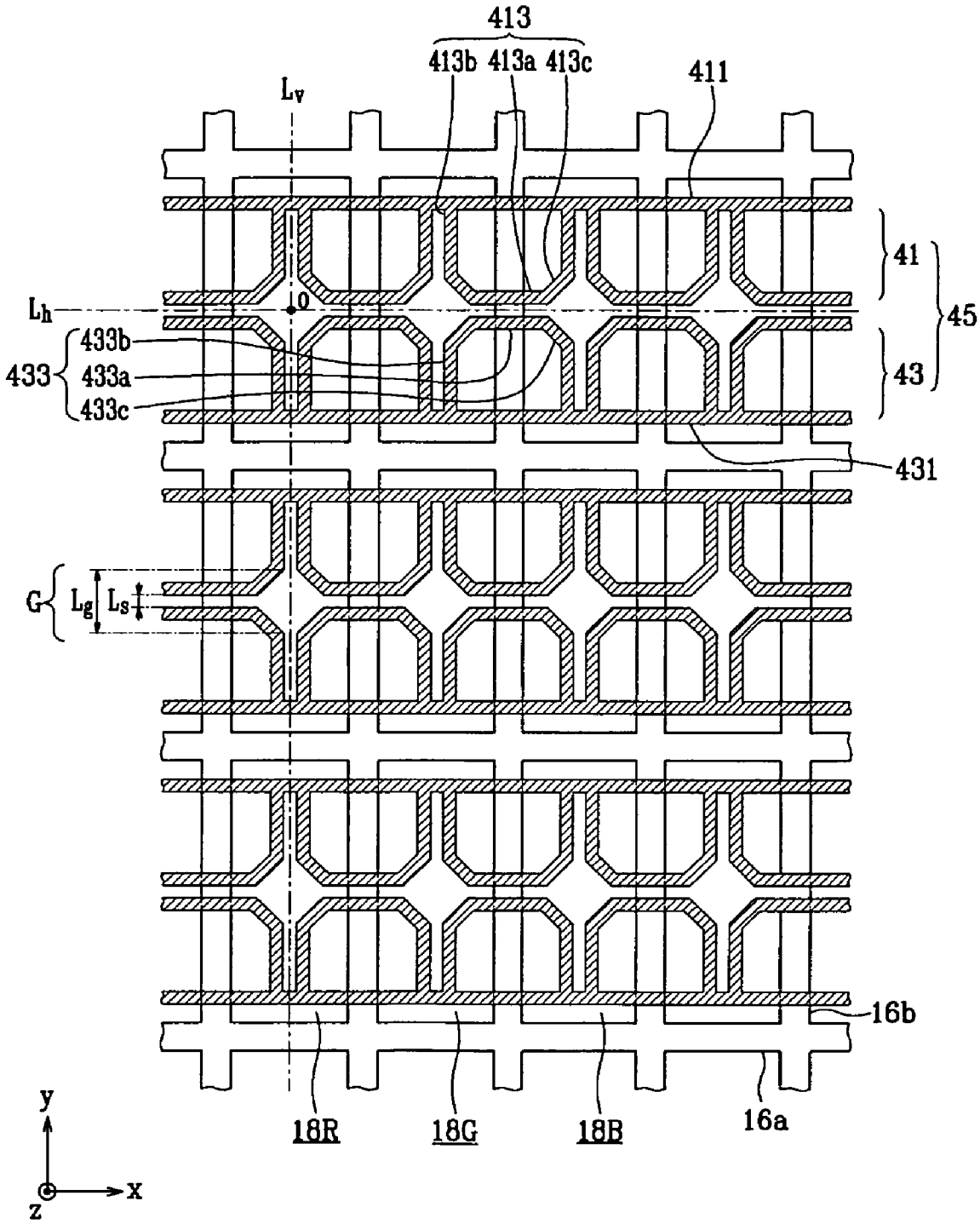
FIG. 5 is a schematic plan view showing an arrangement relationship between display electrodes and discharge cells of the PDP according to the second exemplary embodiment of the present invention.

FIG. 5 is a schematic plan view showing an arrangement relationship between display electrodes and discharge cells of the PDP according to the second exemplary embodiment of the present invention.

Referring to FIG. 5, in the present exemplary embodiment, the line portions 411 of the scan electrodes 41 and the line portions 431 of the sustain electrodes 43 are arranged adjacent to the transverse (or longitudinal) barrier ribs 16*a*. The first electrode portions 413*a* of the scan electrodes 41 and the first electrode portions 433*a* of the sustain electrodes 43 are arranged to cover a pair of adjacent discharge cells in the second direction (x-axis direction in the drawing). According to the present exemplary embodiment, a short discharge gap is formed between the first electrode portions 413*a* of the scan electrodes 41 and the first electrode portions 433*a* of the sustain electrodes 43, unlike in the first exemplary embodiment.

In the meantime, among a pair of adjacent extensions 413 and 433 in the second direction (x-axis direction in the drawing), the second electrode portion 413*b* and 433*b* of the one extension 413 and 433 and the second electrode portion 413*b* and 433*b* of the other extension 413 and 433 are arranged to correspond to one discharge cell 18. In this case, the second electrode portions 413*b* and 433*b* corresponding to the discharge cell 18 are arranged adjacent to the centerline Lv and are arranged opposite to each other with the centerline Lv therebetween. In addition, the second electrode portions 413*b* and 433*b* are connected to each other via the line portions 411 and 431.

In addition, among the pair of adjacent extensions 413 and 433 in the second direction, the third electrode portions 413*c* and 433*c* of the one extension 413 and 433 and the third electrode portions 413*c* and 433*c* of the other extension 413 and 433 are also arranged to correspond to one discharge cell 18 and are arranged adjacent to the center "O" of discharge cell 18. The third electrode portions 413*c* and 433*c* corresponding to the discharge cell 18 are symmetrically arranged with respect to the centerline Lv, and the third electrode portions 413*c* of the scan electrodes 41 and the third electrode portions 433*c* of the sustain electrode 43 are symmetrically arranged with respect to the centerline Lh. That is, the third electrode portions 413*c* and 433*c* are symmetrically formed with respect to the center "O" of the discharge cell 18.

With the above electrode structure, a gap Lg between the third electrode portion 413*c* of the scan electrode 41 and the third electrode portion 433*c* of the sustain electrode 43 may be greater than a gap Ls between the first electrode portion 413*a* of the scan electrode 41 and the first electrode portion 433*a* of the sustain electrode 43. Since two discharge gaps, i.e., short discharge gap and long discharge gap are formed in the present exemplary embodiment, a discharge may be easily diffused into the overall discharge cell.

According to an exemplary embodiment of the present invention, the aperture ratio may be increased because display electrodes are formed in a line shape.

In addition, since the discharge gap is formed as a dual structure, i.e., long discharge gap and short discharge gap, a discharge does not concentrate on centers of the discharge cells and may be diffused into the overall discharge cell.

Further, since a plurality of second electrode portions are formed parallel to the address electrodes in the discharge cells, the discharge may be easily diffused into the overall discharge cell.

In addition, since the electrode portions are formed in a simple shape, the display electrodes may be easily manufactured using various methods such as a direct imaging method.

An exemplary embodiment of the present invention has been disclosed herein, and although specific terms are employed, they are used and are to be interpreted in a generic and descriptive sense only and not for the purpose of limitation. Accordingly, it will be understood by those of ordinary skill in the art that various changes in form and details may be made without departing from the spirit and scope of the present invention as set forth in the following claims.

What is claimed is:

1. A plasma display panel comprising:

a front substrate and a rear substrate arranged opposite to each other;

barrier ribs defining a plurality of discharge cells between said front substrate and said rear substrate;

address electrodes extending in a first direction to correspond to the discharge cells;

phosphor layers formed inside the discharge cells;

a first electrode extending in a second direction crossing the first direction, the first electrode comprising:

a line portion extending in the second direction; and a plurality of extensions protruding from the line portion of the first electrode, the extensions of the first electrode being separated from each other; and a second electrode extending in the second direction, the second electrode comprising:

a line portion extending in the second direction; and a plurality of extensions protruding from the line portion of the second electrode, the extensions of the second electrode being separated from each other, the line portion of the first electrode and the line portion of the second electrode forming a closest discharge gap, the extensions of the first electrode protruding in a direction away from the closest discharge gap, the extensions of the second electrode protruding in a direction away from the closest discharge gap.

2. The plasma display panel of claim 1, wherein said line portions of the first electrode and the second electrode are arranged adjacent to a centerline passing a center of one of the discharge cells in the second direction.

3. The plasma display panel of claim 1, wherein each of said extensions of the first electrode comprises:

a first electrode portion spaced apart from said line portion of the first electrode by a predetermined gap, and a pair of second electrode portions, each of the second electrode portions connecting said first electrode portion to said line portion of the first electrode.

4. The plasma display panel of claim 3, wherein said first electrode portion extends in the second direction, and is arranged to cover a pair of the discharge cells.

5. The plasma display panel of claim 3, wherein one of the second electrode portions of one of the extensions of the first electrode and one of the second electrode portions of another of the extensions of the first electrode are arranged adjacent to a centerline passing a center of one of the discharge cells in the first direction.

6. The plasma display panel of claim 3, wherein recesses are formed in the line portion of the first electrode and faces the second electrode, each of the recesses being formed in a manner that a gap between the each of the recesses and the second electrode is greater than a gap between the first electrode and the second electrode.

7. The plasma display panel of claim 6, wherein each of said second electrode portions connects the first electrode portion to a portion of the line portion of the first electrode in which one of the recesses is formed.

8. The plasma display panel of claim 6, wherein each of the recesses is arranged on a centerline passing a center of one of the discharge cells in the first direction.

9. The plasma display panel of claim 1, wherein said first electrode and said second electrode are made of a metal.

10. The plasma display panel of claim 1, wherein the line portions of the first electrode and the second electrode are symmetric about a center line through the closest discharge gap.

11. The plasma display panel of claim 1, wherein said first electrode and said second electrode are mirror-symmetrically arranged about a center line that formed between the first electrode and the second electrode.

12. A plasma display panel comprising:

a front substrate and a rear substrate arranged opposite to each other;

barrier ribs defining a plurality of discharge cells between said front substrate and said rear substrate;

address electrodes extending in a first direction to correspond to the discharge cells;

phosphor layers formed inside the discharge cells; and a first electrode extending in a second direction crossing the first direction, the first electrode comprising:

a line portion extending in the second direction; and a plurality of extensions protruding from the line portion of the first electrode, the extensions of the first electrode being separated from each other, each of the extensions of the first electrode partially covering two of the discharge cells; and a second electrode extending in the second direction, the second electrode comprising:

a line portion extending in the second direction; and a plurality of extensions protruding from the line portion of the second electrode, the extensions of the second electrode being separated from each other, the extensions of the first electrode and the extensions of the second electrode forming a closest discharge gap, the extensions of the first electrode protruding towards the closest discharge gap, the extensions of the second electrode protruding towards the closest discharge gap.

13. The plasma display panel of claim 12, wherein each of said extensions of the first electrode includes:

a first electrode portion spaced apart from said line portion of the first electrode by a predetermined gap, a pair of second electrode portions, each of the second electrode portions extending toward said first electrode portion from said line portion; and a pair of third electrode portions, each of the third electrode portions connecting one of said second electrode portions to said first electrode portion in an oblique direction.

14. The plasma display panel of claim 13, wherein said first electrode portion extends in the second direction, and is arranged to cover a pair of the discharge cells.

15. The plasma display panel of claim 13, wherein one of the second electrode portions of one of the extensions of the first electrode and one of the second electrode portions of another of the extensions of the first electrode are arranged adjacent to a centerline passing a center of one of the discharge cells in the first direction.

16. The plasma display panel of claim 13, wherein a gap between each of said third electrode portions of said first electrode and said second electrode is greater than a gap between said first electrode portion of said first electrode and said second electrode.

17. The plasma display panel of claim 12, wherein said first electrode and said second electrode are made of a metal.

18. A plasma display panel, comprising:

a plurality of address electrodes extending in a first direction corresponding to a plurality of discharge cells; and a plurality of first electrodes and second electrodes extending in a second direction crossing perpendicularly to the first direction and arranged opposite to each other to form a discharge gap therebetween, each one of said first electrodes and second electrodes comprising:

line portions extending in the second direction, and extensions protruding toward centers of the discharge cells from said line portions, forming the discharge gap, the extensions being separated from each other, and corresponding to a pair of directly adjacent discharge cells in the second direction, with said extensions comprising:

first electrode portions spaced apart from said line portions by a predetermined gap, and a pair of second electrode portions extending toward said first electrode portions from said line portions, and with said first electrode portions covering directly adjacent discharge cells, and said extensions and line portions of said first and second electrodes being symmetric about a center line of each one of the discharge cells.

19. The plasma display panel of claim 1, wherein the line portion of the first electrode is continuously formed connecting the separated extensions of the first electrode to each other, and the line portion of the second electrode is continuously formed connecting the separated extensions of the second electrode to each other.

* * * * *